United States Patent [19]

Genev

[11] Patent Number: 4,936,520

[45] Date of Patent: Jun. 26, 1990

[54] VIBRATING JAW CRUSHER

[75] Inventor: Ivan V. Genev, Sofia, Bulgaria

[73] Assignee: Institute po Tcherna Metalurgia, Sofia, Bulgaria

[21] Appl. No.: 144,307

[22] Filed: Jan. 14, 1988

[51] Int. Cl.[5] ..... B02C 1/02

[52] U.S. Cl. ..... 241/264; 241/289; 241/DIG. 30

[58] Field of Search ..... 241/DIG. 30, 264–269, 241/289, 290

[56] References Cited

U.S. PATENT DOCUMENTS 4,361,289 11/1982 Georget et al. ..... 241/264 X

*Primary Examiner*—Mark Rosenbaum

*Attorney, Agent, or Firm*—Klein & Vibber

[57] ABSTRACT

A vibrating jaw crusher which includes a housing, in the inside of which there are operatively mounted a pair of working jaws. The pair of jaws includes at least one movably mounted jaw. The working surfaces of the rigid and the movable jaws are shaped in the form of a convex and a concave broken (polygonal) line, respectively. The movable jaw is driven by means of a vibrator. The movable jaw is supported by means of elastic elements connected to the top and the bottom end of the jaw. In a preferred embodiment of the invention the rigid and the movable jaws are fastened by means of an axle at their top ends, while their bottom ends are supported by means of elastic elements, which are shaped as rubber pads.

5 Claims, 3 Drawing Sheets

VIBRATING JAW CRUSHER

Field of the Invention

The invention relates to a vibration jaw crusher which can be used in crushing concrete and reinforced-concrete blocks, or other breakable materials having a flat shape, such as building panels, etc.

Description of Prior Art

A known vibrating jaw crusher consists of a housing in the inside of which there are disposed a rigid jaw and a movable jaw, articulately fastened in its top end by means of an axle. The working surfaces of both jaws are shaped in the form of a convex and concave broken (polygonal) lines, respectively, and the working chamber (the space between both jaws) is shaped as an asymmetric curvilinear wedge. The movable jaw is driven by means of a vibrator.

A drawback of such a known vibrating jaw crusher lies in the non-uniform loading of the crushing plates in the crushing of concrete blocks, building panels and other materials of flat shape which have a substantial weight. This drawback has negative results on the wear resistance of the working surfaces and on the energy consumption for the crushing per unit of material.

Summary of the Invention

It is, therefore, a general object of the invention to develop a vibrating jaw crusher which is of simplified design and provides for a uniform loading of the working plates.

This object is achieved by a vibrating jaw crusher which consists of a housing in the inside of which there are disposed the working jaws. The working surfaces of the rigid and the movable jaws are shaped in the form of a convex and a concave broken (polygonal) line. The movable jaw is driven by means of a vibrator. According to the invention, the movable jaw or jaws are fastened by means of elastic elements disposed in the top and the bottom end of the jaw. According to a preferred embodiment of the invention, the rigid and the movable jaws are fastened by means of an axle in the top end, while their bottom end is fastened by means of elastic elements. The elastic elements are shaped as rubber pads.

The advantages of a crusher in accordance with the invention lie in the simplified design of the jaw crusher, where the suspension of the movable jaw by means of elastic elements, such as rubber pads, for example, makes possible a uniform loading of the working jaws when crushing materials of flat shape, such as blocks and building panels.

Brief Description of the Drawings

For a better understanding of the invention, reference should be made to the accompanying drawing in which there are illustrated and described two embodiments of the invention, wherein.

Detailed Description

Figure 1:
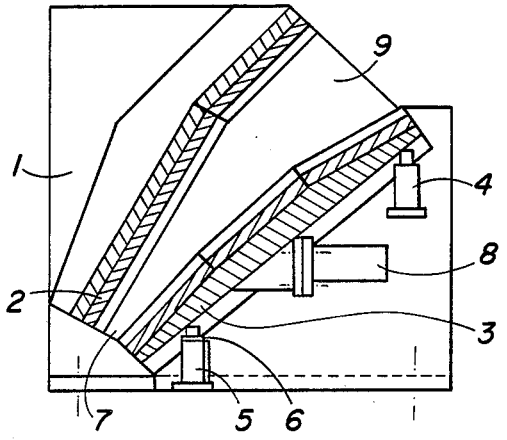
FIG. 1 is a side elevational view of one variant of the jaw crusher wherein a vibrator is attached to the movable jaw.

The embodiment of the invention shown in FIG. 1 consists of a housing 1 in the inside of which there are operatively mounted a rigid jaw 2 and a movable jaw 3. The movable jaw 3 is supported by means of elastic elements 4 and 5 at its top and the bottom ends. To the elastic element 5, mounted in the bottom end of the movable jaw 3, there is connected a device 6 for adjusting the outlet 7 of the crusher. The movable jaw 3 is provided with a vibrator 8, which is disposed between both elastic support elements 4 and 5. The zone of crushing, which is formed by the working surfaces of the jaws 2 and 3 is a curvilinear asymmetric wedge which is inclined with respect to the horizontal plane.

Figure 2:
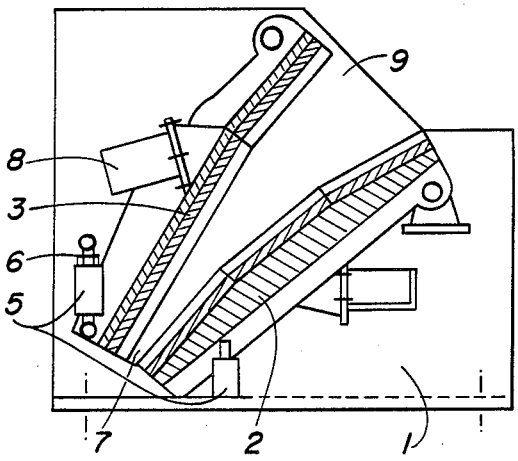
FIG. 2 is a side elevational view of a second variant of the jaw crusher wherein vibrators are attached to both the movable jaw and the rigidly mounted jaw.

Another embodiment of the invention is illustrated in FIG. 2. In this variant of the vibrating jaw crusher both jaws 2 and 3 are articulately suspended at their top ends by means of an axis, while the bottom ends of the jaws 2 and 3 are supported on elastic elements 5, which represent double rubber pads. There is also connected to the elastic support 5 a device for regulating the outlet 7. In this embodiment there are connected vibrators 8 to both jaws 2 and 3.

The vibrating jaw crusher according to the invention operates as follows:

The concrete block to be crushed is fed through the inlet 9 and is directed towards the contracting portion of the working chamber. The high-frequency impacts of the movable jaw produced by the vibrator 8 (frequency 50 Hz and amplitude up to 3 mm) produce constant bending stresses in the material to be crushed so that the blocks, or materials of flat shape, are crushed quickly and easily without any overloading of the working and driving components of the crusher.

The operation and construction of the crusher of the embodiment of FIG. 2 is analogous to the operation described above with the difference being that, in this case, both jaws are subjected to vibration. For similar or equivalent parts the same reference numbers as used in FIG. 1 as are used in FIG. 2.

Figure 3:
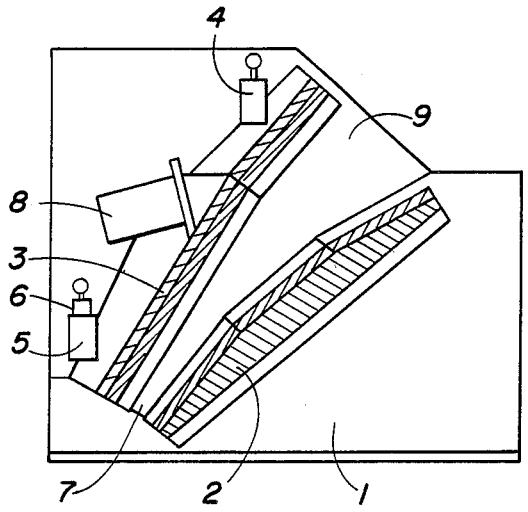
FIG. 3 is a side elevational view of a third variant of the jaw crusher wherein the upper jaw is movable and the lower jaw is immovable.

The operation and construction of the embodiment of FIG. 3 is analogous to the operation and construction of the embodiment of the crusher of FIG. 1 except that in the FIG. 3 embodiment the upper jaw 3 is movable and the lower jaw 2 is rigidly mounted.

Although the invention is described and illustrated with reference to a plurality of embodiments thereof, it is to be expressly understood that it is in no way limited to the disclosure of such preferred embodiments but is capable of numerous modifications within the scope of the appended claims.

I claim:

1. A vibrating jaw crusher comprising a housing a pair of crusher jaws operatively mounted in said housing; at least one of said pair of jaws is movable; each jaw of said pairs of jaws has a working surface operatively arranged in said housing; one of said working surfaces of said pair of jaws is shaped so that a normal intersecting plane would form a convex broken polygonal line with said one working surface, while the other working surface is shaped so that a normal intersecting plane would form a concave broken polygonal line;

a vibrator is operatively connected at least to one of said pair of jaws; and said movable jaw is connected to the housing by means of elastic elements formed as double rubber pads which are mounted in the top and the bottom end of the jaw.

2. A vibrating jaw crusher according to claim 1, wherein said pair of crusher jaws includes a movably mounted jaw and a rigidly mounted jaw.

3. A vibrating jaw crusher comprising a housing;

a rigid and movable jaw each having a working surface and each being operatively arranged in said housing; said working surface of the rigid jaw is shaped in the form of a convex broken line, while said working surface of the movable jaw is shaped in the form of a concave broken line;

vibrators are operatively connected to both the rigid and movable jaws; and the movable jaw is connected to the housing by means of elastic elements in the top and the bottom end of the jaw, said elastic elements are formed as double rubber pads.

4. A vibrating jaw crusher according to claim 3, wherein said pair of jaws includes an includes an upper rigidly mounted jaw and lower movably mounted jaw.

5. A vibrating jaw crusher according to claim 3, wherein said pair of jaws includes an upper movably mounted jaw and lower rigidly mounted jaw.

* * * * *